US010737318B2

(12) United States Patent
Saje et al.

(10) Patent No.: US 10,737,318 B2
(45) Date of Patent: Aug. 11, 2020

(54) METHOD OF MANUFACTURING STRUCTURAL COMPONENTS

(71) Applicant: GM Global Technology Operations LLC, Detroit, MI (US)

(72) Inventors: Robert N. Saje, Shelby Township, MI (US); Paul J. Wolcott, Macomb, MI (US); Keith J. Saari, Macomb Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 267 days.

(21) Appl. No.: 15/909,084

(22) Filed: Mar. 1, 2018

(65) Prior Publication Data

US 2019/0270133 A1 Sep. 5, 2019

(51) Int. Cl.
*B22D 19/04* (2006.01)
*B22D 15/00* (2006.01)

(52) U.S. Cl.
CPC ..... *B22D 19/04* (2013.01); *B22D 15/00* (2013.01)

(58) Field of Classification Search
CPC ..... B22D 19/04; B22D 15/00
USPC ..... 164/75, 98, 111, 112
See application file for complete search history.

(56) References Cited

U.S. PATENT DOCUMENTS

2011/0012320 A1* 1/2011 Kotagiri et al. ..... B60R 19/34 280/124.11

FOREIGN PATENT DOCUMENTS

| | | | |
|---|---|---|---|
| DE | 19639052 | A1 | 3/1998 |
| DE | 102005041340 | A1 | 3/2007 |
| DE | 102008051131 | A1 | 4/2010 |
| DE | 102009035325 | A1 | 2/2011 |
| DE | 102010050874 | A1 | 5/2012 |
| WO | 9639322 | A1 | 12/1996 |

* cited by examiner

*Primary Examiner* — Kevin P Kerns

(57) ABSTRACT

A method of manufacturing a structural support member, the method includes providing a donor casting, separating the donor casting into at least a first segment and a second segment, providing a mold, disposing the first and second segments into the mold, pouring a liquid metal alloy into the mold. recovering and cleaning a solidified structural support member from the mold, and performing an operation for achieving a mechanical lock feature between the first and second segments and the solidified metal alloy.

19 Claims, 7 Drawing Sheets

METHOD OF MANUFACTURING STRUCTURAL COMPONENTS

TECHNICAL FIELD

The present disclosure relates to metal forming manufacturing processes and more particularly to metal casting processes using metal alloys.

INTRODUCTION

Designing and manufacturing structural members for any application is a long process including several iterations of design, prototype, preproduction, and production part levels. Thus there is a great deal of work, time, and money invested into bringing a new part to production level. Additionally, there are several if not hundreds of parts in any assembly that require the same amount of investment. Thus, there is a constant search for ways to reduce the required investment while maintaining the same quality of design and manufacturing.

In some cases, a new part may be very similar to another previously designed part. For example, the new part may be just slightly longer or requires additional features that but for those features the new part would be the same as the original part. Presently, the existing processes would require a whole new design and development cycle for the new part. However, as stated above, the "from scratch" design process is very expensive and requires valuable time and resources. Accordingly, there is a need in the art for an improved manufacturing process that produces high quality, high performance parts at a lower, more competitive cost and in significantly less time.

SUMMARY

The present disclosure provides a method of manufacturing a structural support member. The method includes providing a donor casting, separating the donor casting into at least a first segment and a second segment, providing a mold, disposing the first and second segments into the mold, pouring a liquid metal alloy into the mold, recovering and cleaning a solidified structural support member from the mold, and performing an operation for achieving a mechanical lock feature between the first and second segments and the solidified metal alloy.

In one example of the present disclosure providing a donor casting further comprises providing a donor casting that is a structural support member for a vehicle frame.

In another example of the present disclosure separating the donor casting into at least a first segment and a second segment further comprises separating the donor casting into at least a first segment and a second segment wherein each of the first and second segments have an end, machining the ends of the first and second segments, and cleaning a surface of the ends of the first and second segments.

In yet another example of the present disclosure providing a mold further comprises providing a mold including a mold cavity for forming the structural support member, a gate system, and a chill.

In yet another example of the present disclosure providing a mold further comprises providing a sand mold including a mold cavity for forming the structural support member, a gate system, and a chill.

In yet another example of the present disclosure disposing the first and second segments into the mold further comprises disposing the first and second segments into the mold in prescribed locations thus providing for a cavity to form between the first and second segments.

In yet another example of the present disclosure pouring a liquid metal alloy into the mold further comprises pouring a liquid metal alloy into the gate system of the mold and the liquid metal alloy is one of iron, aluminum alloy, and magnesium alloy.

The above features and advantages and other features and advantages of the present disclosure are readily apparent from the following detailed description when taken in connection with the accompanying drawings.

BRIEF DESCRIPTION OF THE DRAWING

The drawings described herein are for illustration purposes only and are not intended to limit the scope of the present disclosure in any way.

DESCRIPTION

Figure 1:
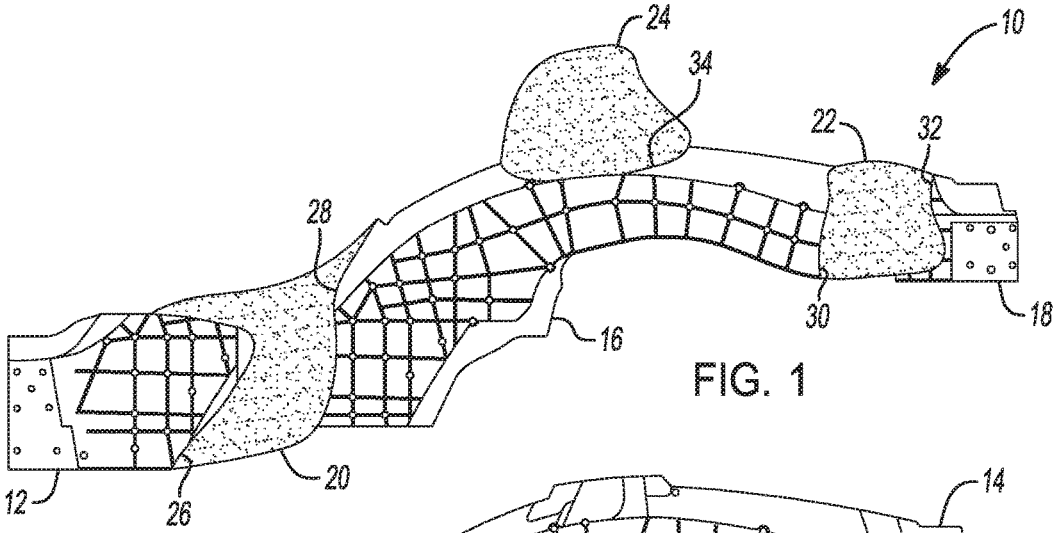
FIG. 1 is a side view of a structural component manufactured using a method according to the principles of the present disclosure.
Figure 2A:
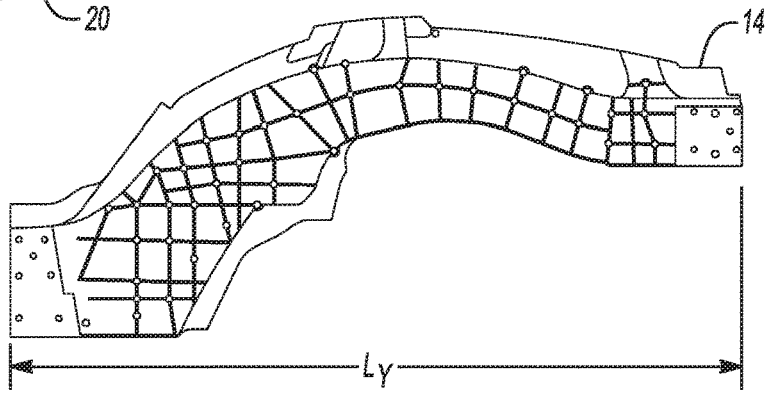
FIG. 2A is a side view of a structural component at the beginning of a method of manufacturing parts according to the principles of the present disclosure.

Referring to the drawings, wherein like reference numbers refer to like components, in FIG. 1 an aluminum alloy structural support member 10 is illustrated in accordance with an example of the present disclosure and will now be described. The structure support member 10 may be employed in a frame of an automobile as a vehicle support member or suspension member. The structure support member 10 can be used in other applications without departing from the scope of the disclosure. The structure support member 10 includes a first segment or portion 12 from a donor casting 14 (shown in FIG. 2A), a second segment or portion 16 from the donor casting 14, and a third segment or portion 18 from the donor casting 14. Additionally, the structure support member 10 further includes a first bridge or splice portion 20, a second bridge or splice portion 22, and an addendum or mount portion 24. More specifically, the first bridge portion 20 mechanically connects a cut end 26 of the first segment 12 to a first cut end 28 of the second segment 16. The second bridge portion 22 mechanically connects a second cut end 30 of the second segment 16 to a cut end 32 of the third segment 18. The addendum portion 24 is disposed on a prepared surface 34 of the second segment 16.

Figure 2B:
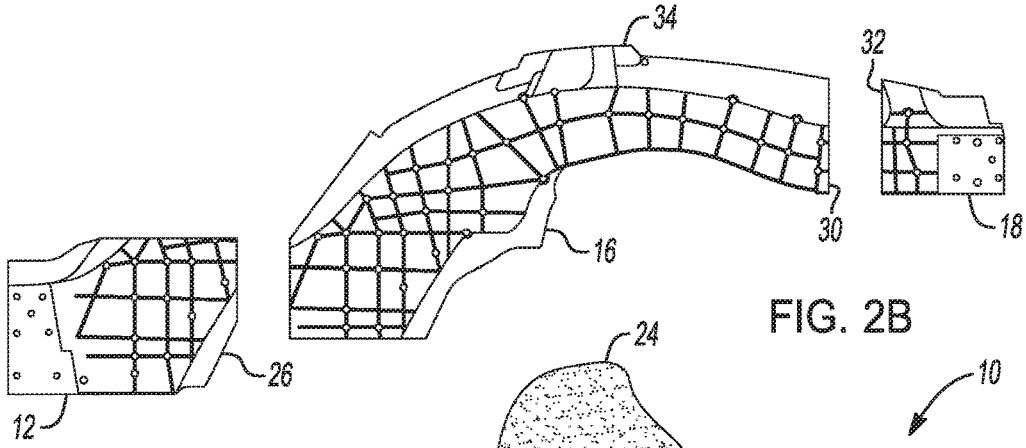
FIG. 2B is a side view of a cut and separated structural component in the middle of a method of manufacturing parts according to the principles of the present disclosure.
Figure 2C:
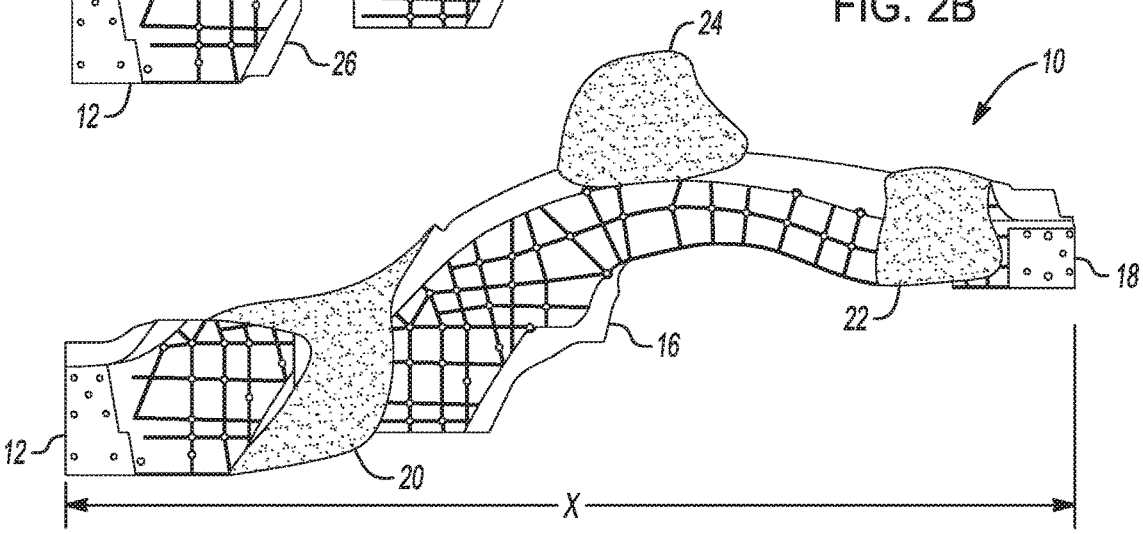
FIG. 2C is a side view of a structural component at the end of a method of manufacturing according to the principles of the present disclosure.
Figure 3:
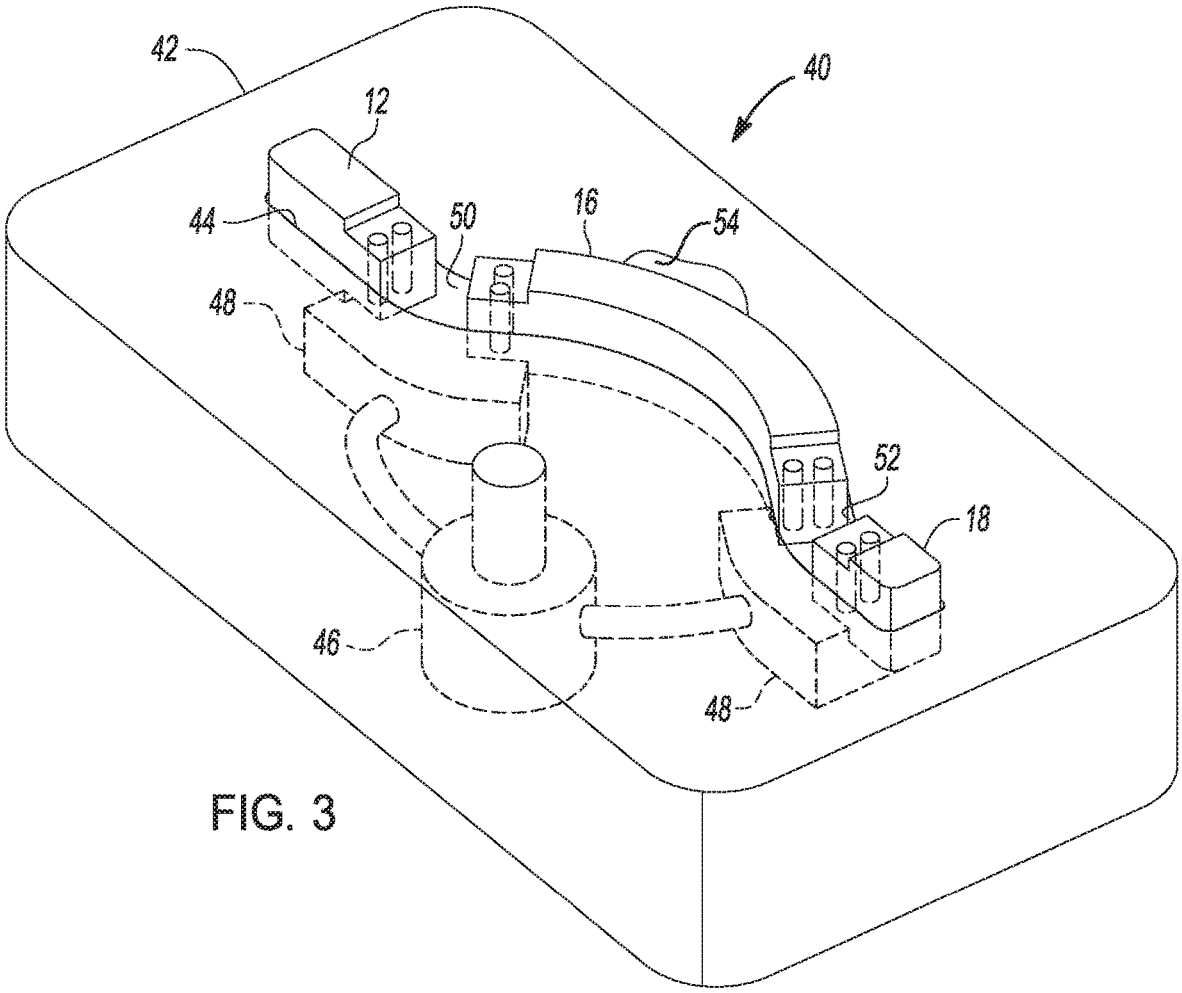
FIG. 3 is a perspective view of a lower half of a mold according to the principles of the present disclosure.
Figure 4:
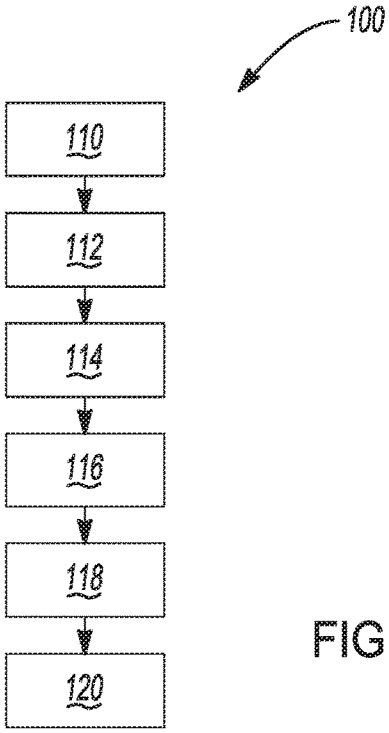
FIG. 4 is flowchart depicting a method of manufacturing metal alloy parts.

Referring now to FIGS. 2A-C, 3, and 4, a process or method 100 for manufacturing the structural support member 10 is illustrated and will now be described. More specifically, FIG. 4 is a flowchart describing the steps of the method 100 while FIGS. 2A-C and 3 illustrate some of the method 100 steps. A first step 110 provides the donor casting 14 (FIG. 2A) which is a similar design to the finished structural support member 10. A second step 112 separates the donor casting 14 into the first segment 12, the second segment 16 and the third segment 18 (FIG. 2B). Other structural support members may have fewer or more separated segments depending upon the state of the donor casting and the changes required to transform the donor casting into the structural support member. A third step 114 treats the end portions of the first, second, and third segments 12, 16, 18 to incorporate a mechanical fastener or locking means between the segments 12, 16, 18 and the bridge or splice portions 20, 22 and the addendum or mount portion 24. Additional treatment of the segments 12, 16, and 18 removes any oxides, lubricants or other contaminants that may have a detrimental effect on the reaction between the segments and the metal alloy. Additionally, while the metal alloy is preferably a lightweight metal alloy such as aluminum or magnesium, more dense alloys may be used such as iron-based alloys without departing from the scope of the disclosure.

A fourth step 116 of the method 100 provides a mold 40 having a cope or upper half (not shown) and a drag or lower half 42 (FIG. 3). The ideal mold 40 is a green sand mold for use in a high sand molding process. However, other casting mold processes may be considered without departing form the scope of the disclosure. For example, a permanent or semi-permanent mold casting process may be used and sand cores for forming internal features may also be incorporated into the casting process. The mold 40 includes a mold cavity 44, an alloy feed gate system 46, chills 48, and risers (in the cope half). When the mold 40 is open, the first, second, and third segments 12, 16, 18 are placed into the mold cavity 44. Locating surfaces are employed to precisely hold the segments 12, 16, 18 in position. As the cope half of the mold 40 is closed upon the drag half 42, the mold cavity 44 is closed to the atmosphere and includes a first, second and third cavity portions 50, 52, 54 that are fed liquid alloy through the gate system 46. Once the mold cavity 44 is filled, the first second and third cavity portions 50, 52, 54 form the bridge or splice portions 20, 22 and the addendum or mount portion 24.

A fifth step 118 of the method 100 breaks the new casting out of the mold after cooling. The new casting is trimmed of excess metal flashing and otherwise cleaned. A sixth step 120 includes an operation for completing the mechanical locking feature. For example, if the mechanical locking feature is a fastener, then the sixth step 120 is a rundown and torque setting of the fastener. Another embodiment of the present disclosure may include the peening of a rivet as the finishing step for the locking feature. Other mechanical locking structures may be considered without departing from the scope of the disclosure. The new casting may be further processed through heat treatment, machining, or other finishing operations to produce the finished structural support member 10. As can be evidenced by a comparison between the donor casting 14 of FIG. 2A and the new casting or structural support member 10 shown in FIG. 2C, the dimensions of the structural support member (for example the length X) is much different than the length $L_Y$ of the donor casting. The method 100 is an enabler to use existing part designs in new applications.

Figure 5A:
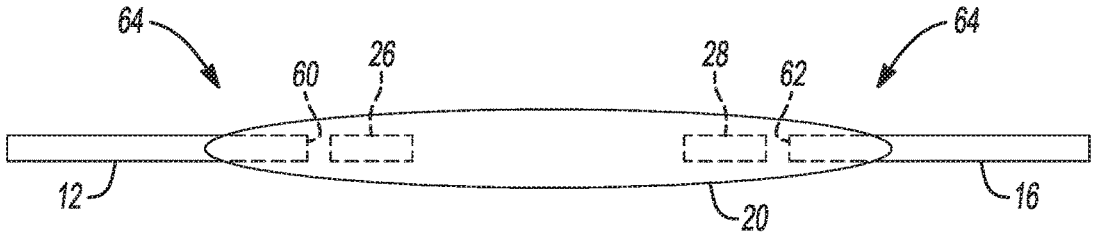
FIG. 5A is a schematic of a structural member manufactured by a method according to the principles of the present disclosure.
Figure 5B:
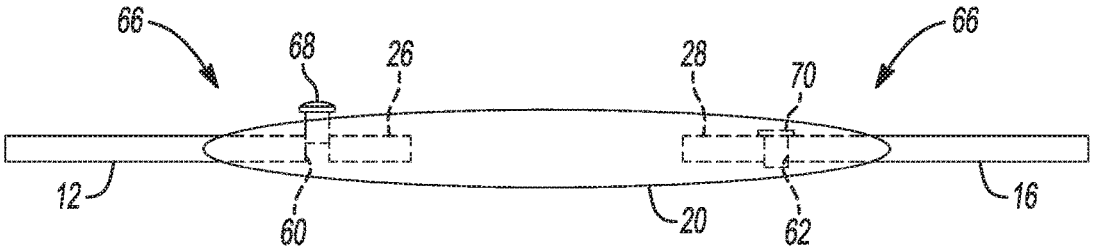
FIG. 5B is a schematic of a structural member manufactured by a method according to the principles of the present disclosure.

Turning now to FIGS. 5A and 5B, an illustration of the first bridge portion 20 of the structural support member 10 is shown and will now be described. As shown above, the area of the structural support member 10 encompassing the bridge portion 20 includes an end 26 of the first segment 12, a first end 28 of the second segment 16, and the bridge portion 20. After the first segment 12 and second segment 16 are separated from the donor casting 14, the ends 26, 28 of the segments 12, 16 are machined or otherwise prepared for a mechanical lock mechanism 64. In the embodiment shown in FIG. 5A the mechanical lock mechanism includes a bore 60 in the end 26 of the first segment 12 through which the liquid alloy passes through and solidified thus forming the mechanical lock mechanism of the bridge 20 and the first segment 12 interface. The mechanical lock mechanism on the interface between the bridge 20 and the second segment 16 includes a bore 62 in the first end 28 of the second segment 16 through which passes liquid alloy that solidifies.

As shown in FIG. 5B, another embodiment of the mechanical lock mechanism 66 is shown. In this example, pins or rivets 68, 70 are disposed in the bores 60, 62 of the ends 26, 28 of the segments 12, 16. The pins 68, 70 may be placed such that the pin 70 is completely covered by the bridge 20 or the pin 68 may be partially exposed for additional mechanical treatment such as peening or other shaping operations. Furthermore, the pins 68, 70 may be placed in the mold prior to pouring the liquid alloy to provide further stability in the interface between the bridge 20 and the segments 12, 16.

Figure 6:
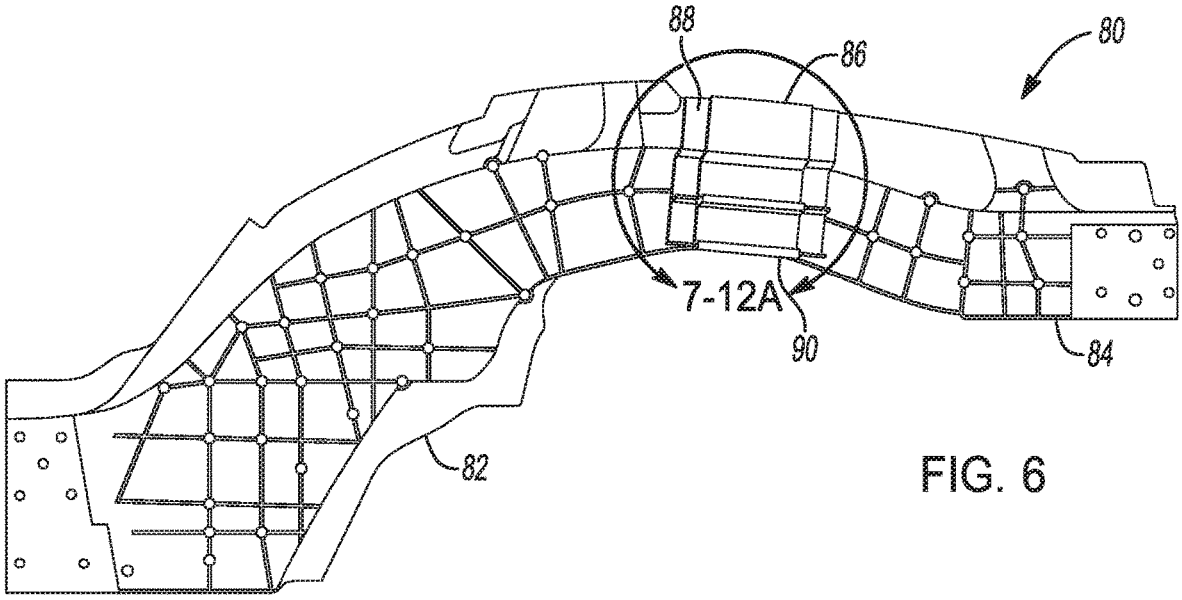
FIG. 6 is a side view of a structural member manufactured by a method according to the principles of the present disclosure.

Turning now to FIG. 6 another example of an aluminum alloy structural support member 80 is illustrated and will now be described. The structure support member 80 may be employed in a frame of an automobile as a vehicle support member or suspension member. The structure support member 80 can be used in other applications without departing from the scope of the disclosure. The structure support member 80 includes a first segment or portion 82 from a donor casting (not shown)) and a second segment or portion 84 from the donor casting. Additionally, the structure support member 80 further includes a bridge or splice portion 86. More specifically, the bridge portion 86 mechanically connects a cut end 88 of the first segment 82 to a cut end 90 of the second segment 84.

Figure 7:
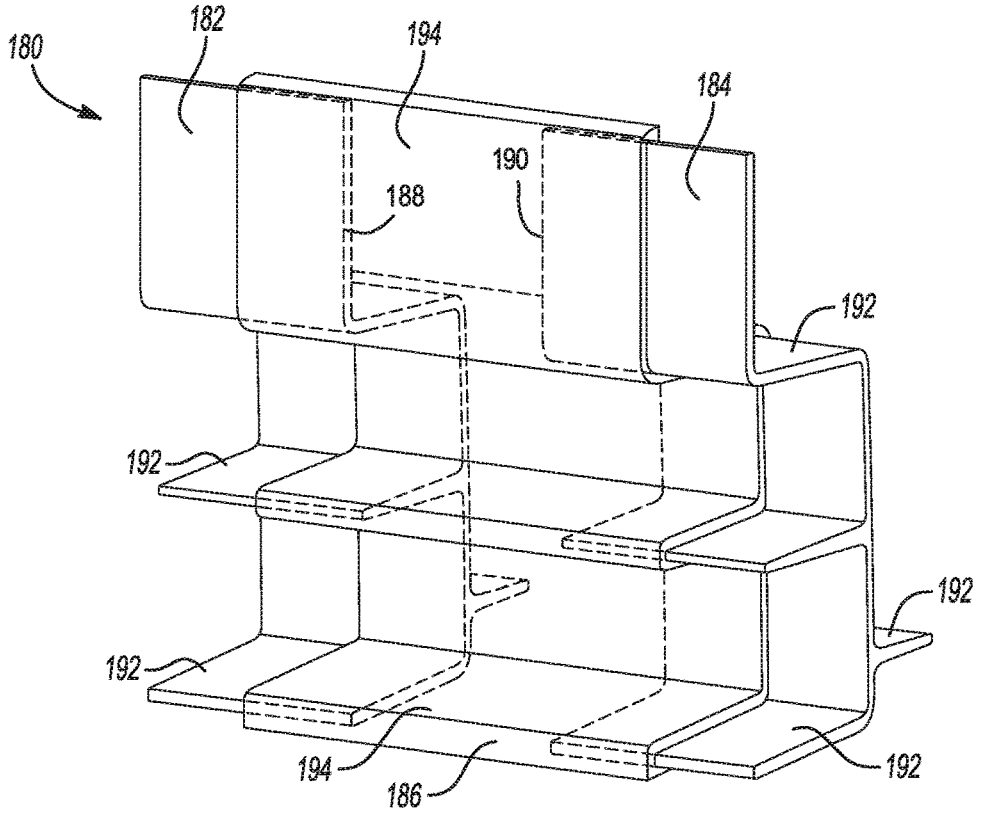
FIG. 7 is a perspective view of a section of a structural member manufactured by a method according to the principles of the present disclosure.
Figure 8:
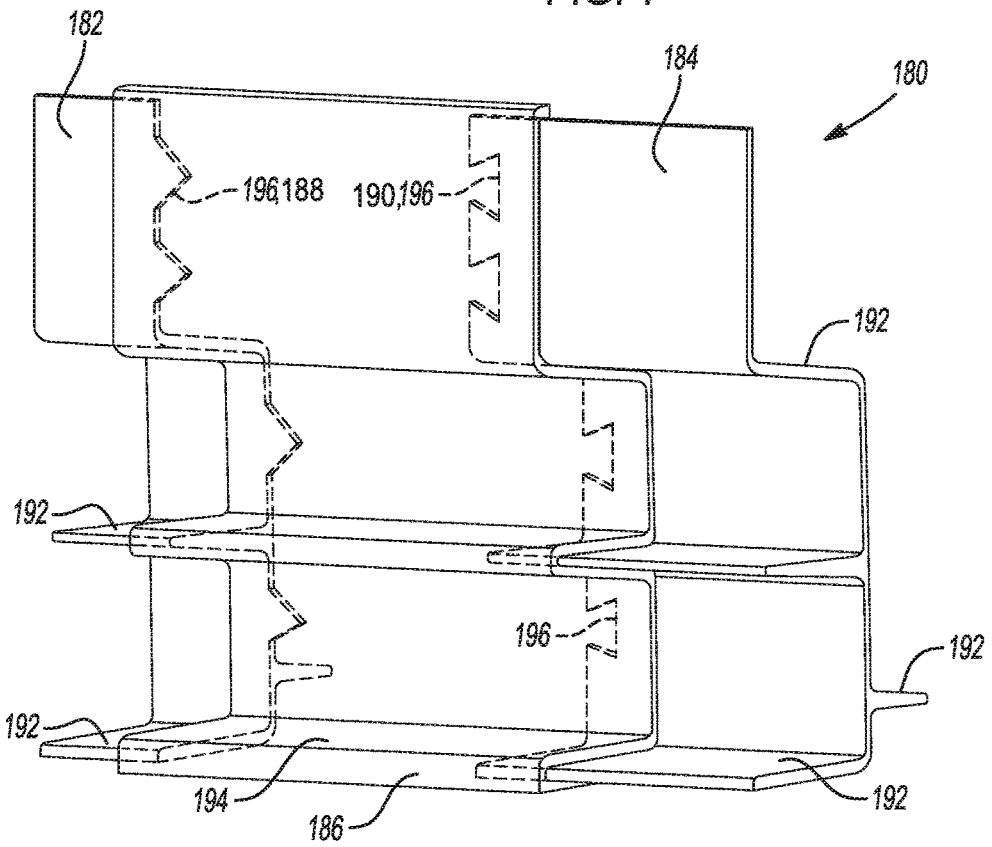
FIG. 8 is a perspective view of a section of a structural member manufactured by a method according to the principles of the present disclosure.

With continuing reference to FIG. 6, FIGS. 7-9 and 10A-12B illustrate several examples of the bridge or splice portion 86 of the structural support member 80 and how the bridge portion 86 mechanically attaches to the cut ends 88, 90 of the first and second segments 82, 84. For example, FIG. 7 illustrates a bridge portion 186 connecting a first segment 182 and a second segment 184. The segments 182, 184 each have a plurality of thin walled ribs 192 arranged to provide stiffness to the structural support member 180. The bridge portion 186 also includes thin walled ribs 194 that coordinate and overlap the thin walled ribs 192 of the segments 182, 184. A shown in FIG. 8, another example of the bridge portion 186 includes a plurality of interlocking surfaces 196 formed into the ends 188, 190 of the segments 182, 184. The interlocking surfaces 196 provide surfaces having different orientations than the surfaces of the ribs 192, 194 to allow additional engagement between the ends 188, 190 and the bridge portion 186.

Figure 9:
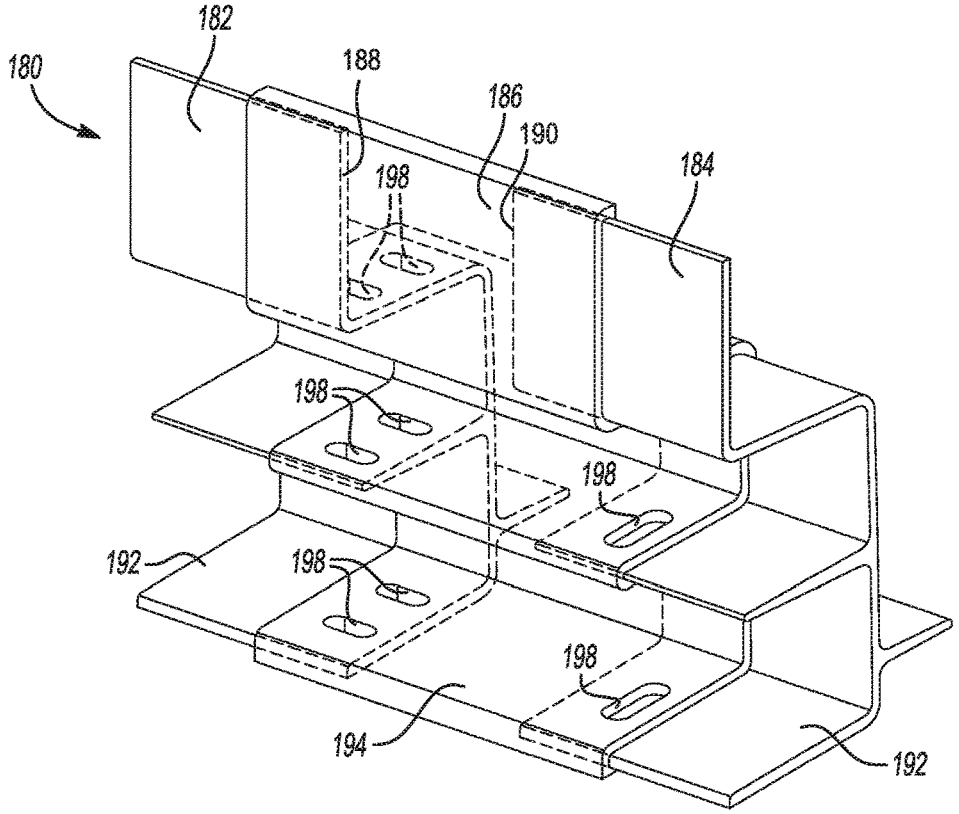
FIG. 9 is a perspective view of a section of a structural member manufactured by a method according to the principles of the present disclosure.
Figure 10B:
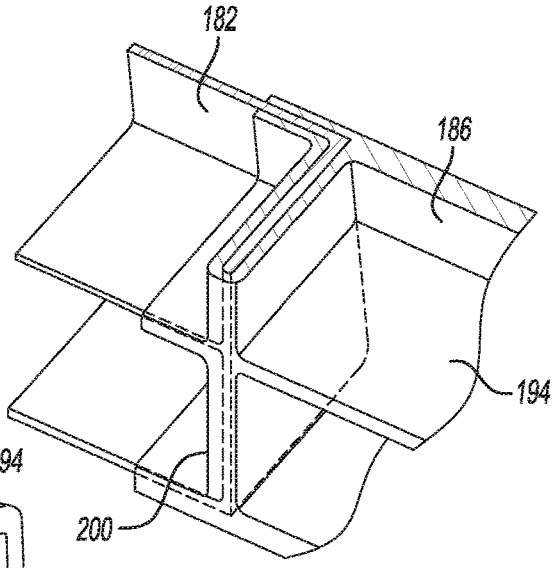
FIG. 10B is a section view of the section of a structural member shown in FIG. 10A manufactured by a method according to the principles of the present disclosure.
Figure 10A:
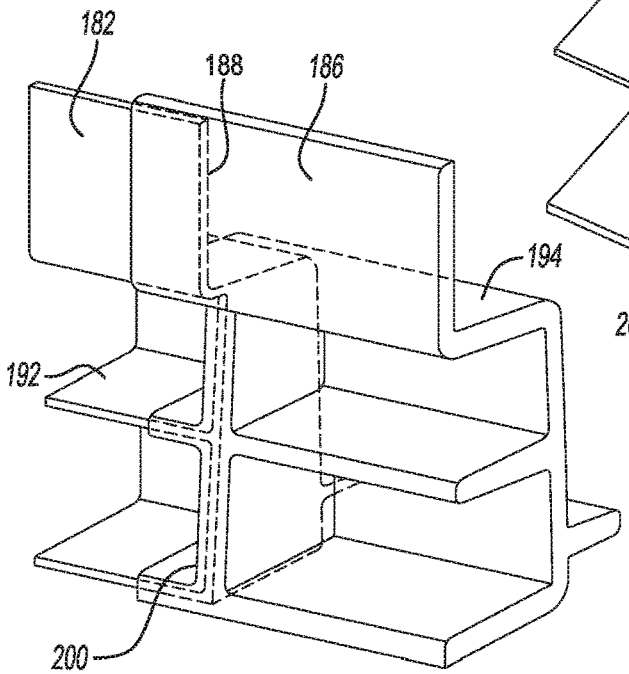
FIG. 10A is a perspective view of a section of a structural member manufactured by a method according to the principles of the present disclosure.
Figure 11A:
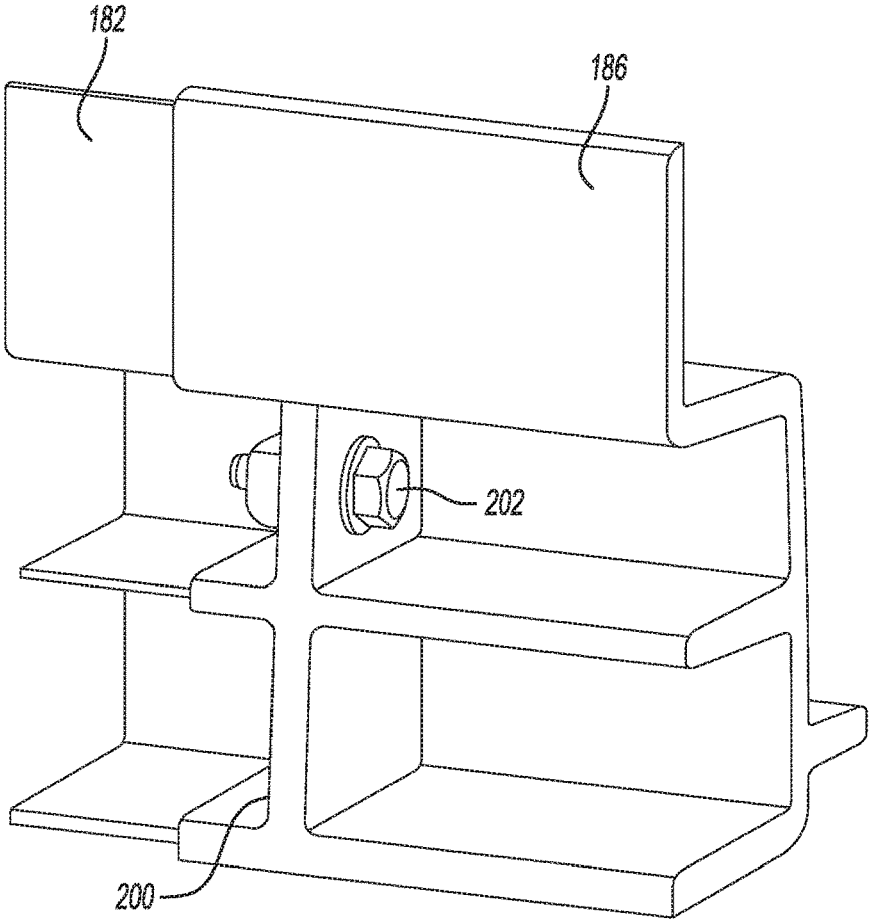
FIG. 11A is a perspective view of a section of a structural member manufactured by a method according to the principles of the present disclosure.
Figure 11B:
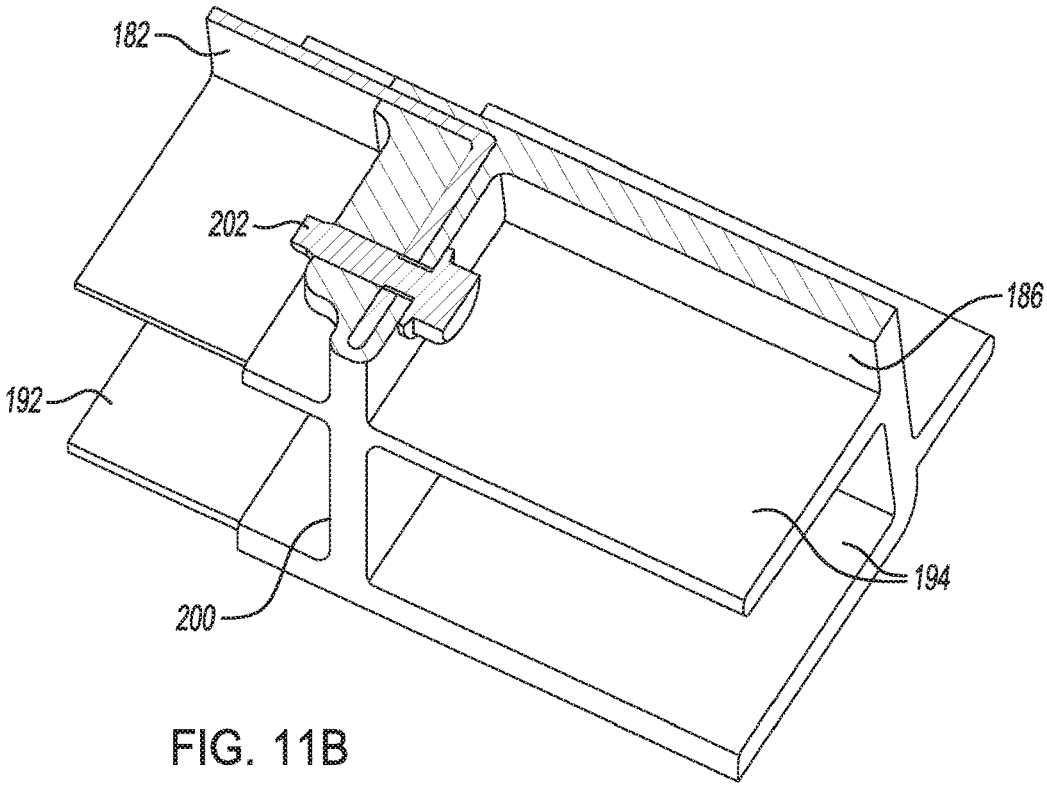
FIG. 11B is a section view of the section of a structural member shown in FIG. 11A manufactured by a method according to the principles of the present disclosure.

As shown in the examples of the bridge portion 186 of the structural support member 180 of FIG. 9, the thin walled ribs 192 of the first and second segments 182, 184 further include a number of bores or holes 198. The bores 198 provide a flow path for the liquid metal alloy to fill upon the casting of the bridge portion 186. As the metal alloy solidifies the filled holes 198 provide an additional mechanical locking surface that improves the overall strength and stiffness of the structural support member 180.

Figure 12A:
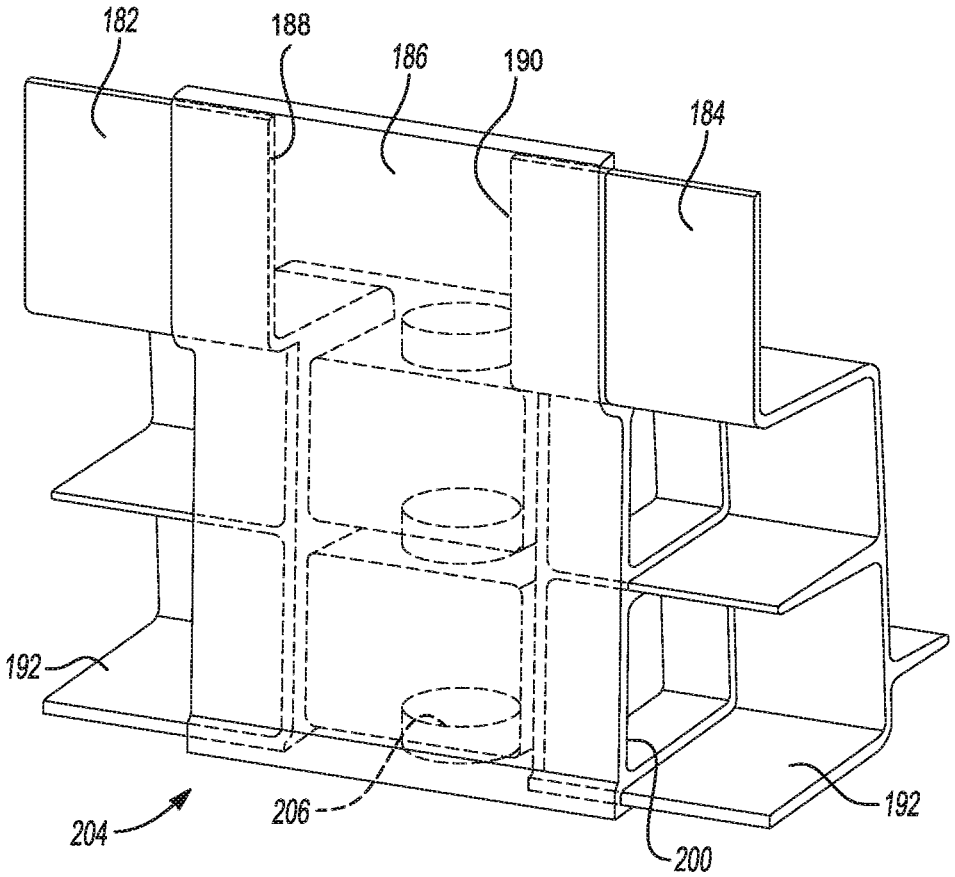
FIG. 12A is a perspective view of a section of a structural member manufactured by a method according to the principles of the present disclosure.
Figure 12B:
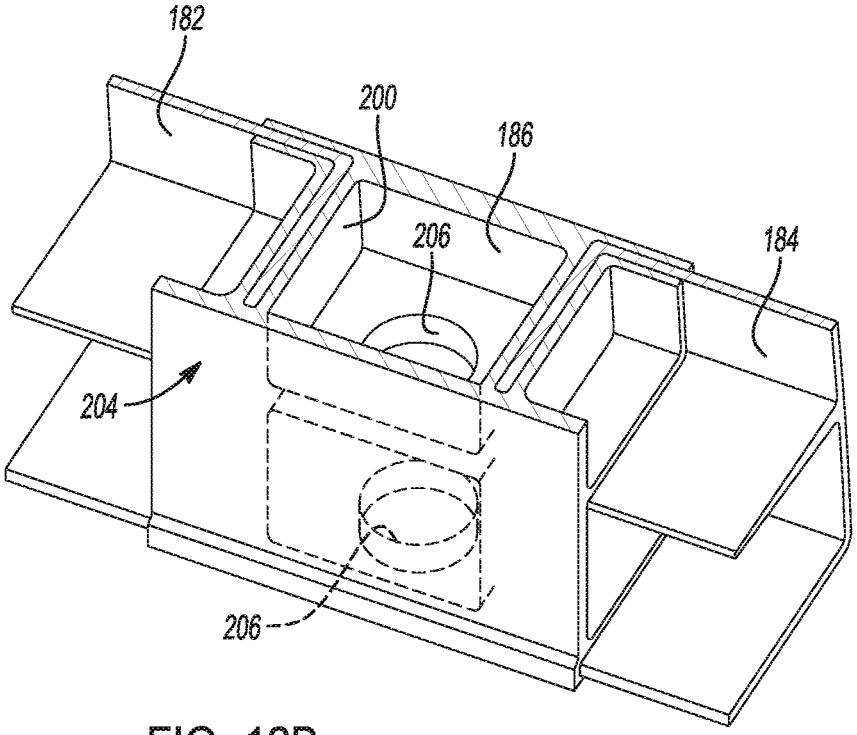
FIG. 12B is a section view of the section of a structural member shown in FIG. 12A manufactured by a method according to the principles of the present disclosure.

In the examples of the present disclosure shown in FIGS. 10A-12B, the ends 188, 190 of the segments 182, 184 include a bulkhead rib 200 that is disposed vertically at the ends 188, 190 of the segments 182, 184. Alone, as in FIGS. 10A and 10B, the bulkhead rib 200 provides yet another opposing surface to provide additional mechanical locking between the bridge portion 186 and the first and second segments 182, 184. The example shown in FIGS. 11A and 11B further include a fastener 202 threaded and torqued through the bulkhead rib 200 thus providing even greater strength and stiffness in applications that require it. In FIGS. 12A and 12B, a double bulkhead box 204 is supplemented with bores or holes 206 to provide an escape route for the otherwise trapped sand of the internal sand core as well as maintaining maximum strength while offering weight savings.

While examples have been described in detail, those familiar with the art to which this disclosure relates will recognize various alternative designs and examples for practicing the disclosed method within the scope of the appended claims.

The following is claimed:

1. A method of manufacturing a structural support member, the method comprising;

providing a donor casting;

separating the donor casting into at least a first segment and a second segment, each of the at least first and second segments having a plurality of thin walled ribs providing stiffness to the structural support member;

providing a mold;

disposing the at least first and second segments into the mold;

pouring a liquid metal alloy into the mold;

recovering and cleaning a solidified structural support member from the mold, wherein the liquid metal alloy solidifies to form a bridge portion having a plurality of thin walled ribs that coordinate and overlap the thin walled ribs of the at least first and second segments; and performing an operation for achieving a mechanical interlock feature between the at least first and second segments and the solidified metal alloy, wherein the mechanical interlock feature is formed into ends of the at least first and second segments, and each of the mechanical interlock features having different orientations than surfaces of the thin walled ribs.

2. The method of manufacturing a structural support member of claim 1, wherein providing a donor casting further comprises providing a donor casting that is a structural support member for a vehicle frame.

3. The method of manufacturing a structural support member of claim 1, wherein separating the donor casting into at least a first segment and a second segment further comprises separating the donor casting into each of the at least first and a second segments wherein each of the at least first and second segments have an end, machining the ends of the first and second segments, and cleaning a surface of the ends of each of the first and second segments.

4. The method of manufacturing a structural support member of claim 1, wherein providing a mold further comprises providing a mold including a mold cavity for forming the structural support member, a gate system, and a chill.

5. The method of manufacturing a structural support member of claim 4, wherein pouring a liquid metal alloy into the mold further comprises pouring a liquid metal alloy into the gate system of the mold and the liquid metal alloy is one of iron, aluminum alloy, and magnesium alloy.

6. The method of manufacturing a structural support member of claim 1, wherein providing a mold further comprises providing a sand mold including a mold cavity for forming the structural support member, a gate system, and a chill.

7. The method of manufacturing a structural support member of claim 1, wherein disposing each of the at least first and second segments into the mold further comprises disposing each of the at least first and second segments into the mold in prescribed locations, thus providing for a cavity to form between each of the at least first and second segments.

8. The method of manufacturing a structural support member of claim 1 wherein performing an operation for achieving a mechanical interlock feature between the first and second segments and the solidified metal alloy further comprises forming the mechanical interlock features as a quantity of bores or holes formed through each of the at least first and second segments.

9. A method of manufacturing a structural support member, the method comprising;

providing a donor casting;

separating the donor casting into at least a first segment and a second segment, wherein each of the at least first and second segments has an end, machining the ends of the at least first and second segments, and cleaning a surface of the ends of the at least first and second segments, each of the at least first and second segments having a plurality of thin walled ribs providing stiffness to the structural support member;

providing a mold including a mold cavity for forming the structural support member, a gate system, and a chill;

disposing the at least first and second segments into the mold; and pouring a liquid metal alloy into the mold;

recovering and cleaning a solidified structural support member from the mold wherein the liquid metal alloy solidifies to form a bridge portion having a plurality of thin walled ribs that coordinate and overlap the thin walled ribs of the at least first and second segments; and performing an operation for achieving a mechanical interlock feature between each of the at least first and second segments and the solidified metal alloy, wherein the mechanical interlock feature is formed into the ends of each of the at least first and second segments, and each of the mechanical interlock features having different orientations than surfaces of the thin walled ribs.

10. The method of manufacturing a structural support member of claim 9, wherein providing a donor casting further comprises providing a donor casting that is a structural support member for a vehicle frame.

11. The method of manufacturing a structural support member of claim 9, wherein performing an operation for achieving a mechanical interlock feature between the first and second segments and the solidified metal alloy further comprises forming the mechanical interlock features as a quantity of bores or holes formed through each of the at least first and second segments.

12. The method of manufacturing a structural support member of claim 11, wherein providing a mold further comprises providing a sand mold including a mold cavity for forming the structural support member, a gate system, and a chill.

13. The method of manufacturing a structural support member of claim 12, wherein disposing each of the at least first and second segments into the mold further comprises disposing the first and second segments into the mold in prescribed locations, thus providing for a cavity to form between each of the at least first and second segments.

14. The method of manufacturing a structural support member of claim 13, wherein pouring a liquid metal alloy into the mold further comprises pouring a liquid metal alloy into the gate system of the mold, and the liquid metal alloy is one of iron, aluminum alloy, and magnesium alloy.

15. The method of manufacturing a structural support member of claim 14 further comprising recovering and cleaning a solidified structural support member from the mold.

16. The method of manufacturing a structural support member of claim 15 further comprising performing an operation for achieving a mechanical interlock feature between each of the at least first and second segments and the solidified metal alloy.

17. A method of manufacturing a structural support member, the method comprising;

providing a donor casting that is a structural support member for a vehicle frame;

separating the donor casting into at least a first segment and a second segment wherein each of the at least first and second segments has an end, machining each of the ends of each of the at least first and second segments, and cleaning a surface of each of each of the ends of each of the at least first and second segments, each of the at least first and second segments having a plurality of thin walled ribs providing stiffness to the structural support member;

providing a mold including a mold cavity for forming the structural support member, a gate system, and a chill;

disposing the first and second segments into the mold in prescribed locations thus providing for a cavity to form between each of the at least first and second segments;

pouring a liquid metal alloy into the gate system of the mold and the liquid metal alloy is one of iron, aluminum alloy, and magnesium alloy;

recovering and cleaning a solidified structural support member from the mold; wherein the liquid metal alloy solidifies to form a bridge portion having a plurality of thin walled ribs that coordinate and overlap the thin walled ribs of each of the at least first and second segments wherein the liquid metal alloy solidifies to form a bridge portion having a plurality of thin walled ribs that coordinate and overlap the thin walled ribs of each of the at least first and second segments, and performing an operation for achieving a mechanical interlock feature between each of the at least first and second segments and the solidified metal alloy, wherein the mechanical interlock feature is formed into each of the ends of the at least first and second segments, and each of the mechanical interlock features having different orientations than surfaces of the thin walled ribs, and forming the mechanical interlock features as a quantity of bores or holes formed through each of the at least first and second segments.

18. The method of manufacturing a structural support member of claim 17, wherein providing a mold further comprises providing a sand mold including a mold cavity for forming the structural support member, a gate system, and a chill.

19. The method of manufacturing a structural support member of claim 17, wherein pouring a liquid metal alloy into the mold further comprises pouring a liquid metal alloy into the gate system of the mold, and the liquid metal alloy is one of iron, aluminum alloy, and magnesium alloy.

* * * * *